US007441503B1

(12) United States Patent
Callaway

(10) Patent No.: US 7,441,503 B1
(45) Date of Patent: Oct. 28, 2008

(54) EXPENDABLE INFRA-RED RADIATING MEANS

(75) Inventor: James D. Callaway, Farnborough (GB)

(73) Assignee: The Secretary of State for Defence in Her Brittanic Majesty's Government of the United Kingdom of Great Britain and Northern Ireland, Farnborough, Hants (GB)

( * ) Notice: Subject to any disclaimer, the term of this patent is extended or adjusted under 35 U.S.C. 154(b) by 1826 days.

(21) Appl. No.: 08/848,093

(22) Filed: Jun. 9, 1997

(30) Foreign Application Priority Data

Jun. 17, 1996 (GB) ..... 9612655.2

(51) Int. Cl.
*F42B 4/26* (2006.01)

(52) U.S. Cl. ..... 102/336; 102/342; 149/22; 149/37; 149/42; 149/75; 149/108.6

(58) Field of Classification Search ..... 102/336, 102/342; 149/22, 37, 42, 75, 108.6
See application file for complete search history.

(56) References Cited

U.S. PATENT DOCUMENTS

| | | | | | |
|---|---|---|---|---|---|
| 3,578,974 | A | | 5/1971 | Thomas et al. | |
| 3,908,550 | A | | 9/1975 | Beatty et al. | |
| 3,983,816 | A | * | 10/1976 | Cornia et al. | 102/37.8 |
| 4,697,521 | A | * | 10/1987 | Espagnacq et al. | 102/334 |
| 4,724,018 | A | * | 2/1988 | Espagnacq et al. | 149/21 X |
| 5,056,435 | A | * | 10/1991 | Jones et al. | 102/336 |
| 5,390,605 | A | | 2/1995 | Meili et al. | |
| 5,445,078 | A | * | 8/1995 | Marion | 102/505 |
| 5,472,533 | A | | 12/1995 | Herbage et al. | |
| 5,499,582 | A | | 3/1996 | Schiessl et al. | |
| 5,585,594 | A | * | 12/1996 | Pelham et al. | 102/336 |
| 5,587,552 | A | * | 12/1996 | Dillehay et al. | 149/19.5 |

FOREIGN PATENT DOCUMENTS

| | | |
|---|---|---|
| EP | 0 309 097 | 3/1989 |
| GB | 1 331 981 | 9/1973 |
| GB | 1 534 134 | 11/1978 |
| GB | 1 573 645 | 8/1980 |
| GB | 1 577 901 | 10/1980 |
| GB | 2 162 621 | 2/1986 |
| GB | 2 266 944 | 11/1993 |
| GB | 2 283 303 | 5/1995 |
| GB | 2 283 559 | 5/1995 |
| WO | WO 94/02435 | 2/1994 |
| WO | WO 94/02436 | 2/1994 |

* cited by examiner

*Primary Examiner*—J. Woodrow Eldred
(74) *Attorney, Agent, or Firm*—Nixon & Vanderhye P.C.

(57) ABSTRACT

An expendable infra-red radiating means having a rupturable container 1 housing a plurality of decoy plates (11) and an ignition means (17) for igniting the decoy plates (11). Each of the decoy plates (11) comprises a composition of a metal and an oxidant capable of an exothermic combustion reaction upon ignition which produces negligible quantities of radiation in the visible or ultra-violet regions and which results, after the combustion reaction is completed, in the decoy plates (11) containing hot metal emitting infra-red radiation.

19 Claims, 2 Drawing Sheets

EXPENDABLE INFRA-RED RADIATING MEANS

BACKGROUND OF THE INVENTION

1. Field of the Invention

The present invention relates to a covert, expendable infra-red (IR) radiating means and in particular to a covert countermeasure or decoy flare capable of generating an IR interference cloud to divert an incoming missile equipped with an IR seeker system away from its intended target or to create a covert IR screen.

2. Discussion of Prior Art

Known IR decoy flares conventionally comprise pyrotechnic compositions bound together with an organic binder and pressed to form pellets. When an incoming missile is detected a pellet is ignited and launched from the target. The pellet burns over its surface to produce an intense infra-red source which can lure the infra-red seeker system of the missile away from the target.

However, advances in missile seeker systems and the development of 'intelligent' missile systems have led to seeker systems which are designed to recognise the typical characteristics of a decoy flare and ignore it. Some advanced seeker systems are programmed with a characteristic infra-red signature of the intended target, the exhaust plume of a jet aircraft for example, and will ignore the almost point like radiating source of a conventional flare.

There has therefore become a need for a countermeasure which radiates over a large area, either to appear more like the intended target to the missile system or to act as a screen, especially for larger or slower moving targets.

One known decoy flare which is capable of generating a large cloud emitting in the infra-red range is described in the U.S. Pat. No. 4,624,186. This flare comprises a casing containing combustible flakes and an ignition expediting material. These combustible flakes comprise a thin base material, such as paper or metal foil, on to which is pressed a phosphorus containing incendiary paste. In use, the flare is launched into the air and the ignition expediting material creates a fireball which passes through the combustible flakes, igniting the incendiary paste which burns to emit IR radiation and spreading the flakes which float slowly downward creating the interference cloud.

One problem with this type of flare is that phosphorus has a characteristic IR emission spectrum which some 'intelligent' seeker systems can be programmed to ignore. Also, these types of flares are quite expensive. Further this type of flare also radiates in the visible and ultra-violet (UV) regions and produces a large, visible smoke cloud. This has the disadvantage of revealing that a countermeasure has been deployed which can indicate that a certain threat has been detected.

Furthermore, some 'intelligent' seeker systems use other radiation, for example UV emission, when deciding to ignore some IR sources and are therefore not deflected by flares emitting significant amounts of radiation in the visible or UV regions. Also, some missile systems, for example ones often employed in ground based anti-aircraft batteries, require human operators to make an initial target acquisition for a particular missile before the IR seeker system of that missile guides it to its acquired target. This target acquisition is done visually and hence, particularly at night, illumination of the target by the visible emission from the decoy is undesirable.

One known type of covert flare uses Activated Metal Disks (AMDs). These are disks of metals made pyrophoric by a process described in U.S. Pat. No. 4,895,609. The disks are held in a store which, on ejection from the target, ruptures to dispense the disks. As the disks are pyrophoric they ignite on contact with the air and burn to act as a decoy.

However this type of flare is expensive to produce and, due to the pyrophoric nature of the disks, has a relatively large delay before becoming effective as the disks have to be ejected and dispensed before ignition can occur. For some applications, e.g. for fast moving vehicle decoys, the narrow field of view of some modern seeker systems means that the disks can be outside the missiles effective vision by the time combustion is fully underway and will not therefore be effective as a decoy. Also, the mass of a flare of this type can be significantly greater than standard IR flares.

SUMMARY OF THE INVENTION

It is therefore an aim of the present invention to provide an IR radiator which alleviates at least some of the aforementioned problems.

According to the present invention there is provided an expendable infra-red radiating means comprising a rupturable container, a plurality of decoy plates housed within the rupturable container and an ignition means for igniting the decoy plates wherein the decoy plates comprise a composition of a metal and an oxidant capable of an exothermic combustion reaction upon ignition, the composition being selected such that the combustion reaction produces negligible radiation in the visible and ultra violet regions and wherein following completion of the combustion reaction the decoy plate comprises hot metal emitting infra-red radiation.

In use the container is deployed into the air and the decoy plates are ignited by the ignition means. The container is then ruptured, for example by build up of pressure within the container, to dispense the decoy plates to form a cloud of IR radiation sources.

Use of a composition of a metal and an oxidant capable of an exothermic combustion reaction upon ignition for the decoy plates provides a relatively inexpensive flare capable of generating a cloud of material which is emitting strongly in the IR range.

As the combustion reaction primarily produces heat, which may be stored in the hot metal which remains after the reaction has ended, the decoy plates, during and after combustion, produce negligible amounts of radiation in the visible or UV regions. In daylight, when the decoy plates are deployed as a screen or as a decoy flare, the small amount of visible radiation will not be seen against the background light. Even at night, the dispersal of the disks means that the glow of the plates in the visible region will be virtually undetectable at the ranges concerned. Therefore the countermeasure may be deployed covertly. Also a missile seeker system will not see any radiation in the UV region which would be characteristic of a decoy flare.

Metal present after the combustion of the decoy plate will be hot due to the heat generated during combustion and therefore will be emitting in the IR range but will have negligible visible or UV radiation. The decoy is therefore effective beyond the duration of combustion of the decoy plates and a decoy cloud having a relatively long duration can be produced without the need for slow burning compositions.

As a consequence the duration of the combustion reaction can actually be reduced and fast burning compositions can be chosen for their heat generation properties. The combustible composition also has a fast ignition time and the decoy plates can be ignited before dispersal ensuring that the plates become effective within the missiles field of view. Minimising the duration of the ignition of the decoy plates is also advantageous because the ignition reaction produces not only heat but visible and ultra-violet (UV) emission.

A further advantage is that the IR emission spectrum of the decoy plate after the combustion reaction has finished will be characteristic of hot metal which is to be expected from a target, for example the hot metal parts of a tank engine or an aircraft exhaust, and will not include any components which the seeker system will recognise as artificial and characteristic of a decoy.

Also, the electrical conduction of the plates and any metal existing after reaction means that the cloud produced is formed of conducting elements which could reflect radio frequency (RF) signals and therefore act as a large RADAR reflective surface. The cloud, due to its conducting properties, could also both reflect any RF signals generated by the target thereby possibly confusing any systems which look for these signals or alternatively could scatter any incident RADAR pulses which may result in deflecting a system which uses active RADAR guidance.

In order to ensure that the decoy functions effectively after combustion the composition of the decoy plates is preferably selected such that the mass of hot metal emitting infra-red radiation after combustion of a decoy plate is at least 10% of the mass of the decoy plate before combustion. For a decoy relying on hot metal remaining after the reaction, the amount of that metal remaining should be at least 10% of the mass of the decoy plate to ensure that the plates are acting efficiently.

Preferably the composition of the decoy plates comprises an excess of metal.

Ignition and combustion of a decoy plate produces heat due to the combustion reaction between the metal and the oxidant. The excess metal does not undergo reaction and absorbs a lot of the heat generated during the reaction thereby resulting in hot metal remaining after the end of the reaction.

It will be clear to one skilled in the art that by varying the ratio of metal to oxidant present in the composition of the decoy plates, the amount of metal remaining after the reaction can be altered, as can the amount of heat generated.

Advantageously the composition of the decoy plates is selected such that a reaction product of the exothermic combustion reaction between the metal and the oxidant is hot metal emitting infra-red radiation.

By producing metal in the combustion reaction then the proportion of the decoy plate which undergoes reaction can be high whilst retaining the advantages of having metal present after the reaction has finished. Thus the proportion of excess metal could be reduced, which could result in more heat being generated, whilst retaining the same proportion of metal present after reaction.

Alternatively production of a metal in the combustion reaction means that all the metal of the decoy plate could take part in the combustion reaction and there would still be hot metal at the end of the reaction. This could allow the metal of the plate to be chosen because of its properties as a fuel whereas the metal produced could be selected for its thermal properties, for instance thermal conductivity or melting point.

Metal may conveniently be produced by ensuring that the metal of the decoy plate is a first metal and the oxidant is an oxide of a second metal. Upon ignition the first metal and second metal oxide undergo a combustion reaction wherein the oxide of the second metal dissociates to produce the second metal and the first metal reacts with the dissociated oxygen to form an oxide of the first metal.

Suitable metal fuels liberate large amounts of heat in the combustion reaction and include aluminium, iron, calcium, titanium, silicon and boron although it will be apparent to one skilled in the art that other metals could be used. The oxidant must obviously be such that it will be reduced in the combustion reaction and liberate sufficient heat and the skilled worker could easily determine suitable oxidants for a given metal fuel. For aluminium, for example, suitable oxidants include ferric oxide, calcium oxide, tungsten dioxide or trioxide, manganese dioxide and sodium chlorate.

One advantageous composition of a decoy plate has iron as the metal and potassium perchlorate as the oxidant. This composition is inexpensive and reliable and burns to produce potassium chloride and oxides of iron. Preferably 82 to 88% by weight of the decoy plate is iron and 18 to 12% by weight of the decoy plate is potassium perchlorate. This ratio is optimised to give maximum thermal and electrical conduction before, during and after combustion, due to the excess iron.

An alternative composition in which metal is produced has aluminium as the metal and ferric oxide as the oxidant. This composition burns to produce iron and aluminium oxide. A nearly stoichiometric composition of aluminium and ferric oxide is preferably used in order to maximise efficiency.

A further composition which could be used, in which metal is produced, has titanium as the metal and manganese dioxide as the oxidant. This composition burns to produce manganese and oxides of titanium. It will be apparent to one skilled in the art however that other such compositions could be used.

Preferably the decoy plates comprise a pressed composition of a particulate metal and particulate oxidant.

Pressing the composition to form the decoy plates offers an inexpensive and simple method of manufacture with reliable results. The size of the particles has an effect on the heat of the reaction and can be varied for different applications although it will be apparent to one skilled in the art to choose particle sizes that are not too large as to give inefficient burning or problems with ignition but that are not too small as to lead to problems with safety and uncontrollability with the plates being too sensitive. The pressing loads will likewise be such to ensure good metal to oxidant contact.

The decoy plate composition may advantageously further comprise a binder material to improve the stability of the plates and to modify the thermal characteristics of the plates.

Advantageously the thicknesses of the decoy plates are adapted such that, in use, at least some of the decoy plates break up on dispersal from the rupturable container. The shock of ejection into the atmosphere from the rupturable container causes thin plates to break up on ejection. This results in a cloud having IR emitting pieces of differing sizes. The differing sized pieces would have different air resistances which would aid in spreading the cloud over a large area. Also the varying sized pieces, because of their conductive properties, could have a greater RADAR reflection potential.

Most usefully the decoy plates have grooves running across the surface. Grooves aid in fracturing of plates, especially after the combustion reaction between the metal and the oxidant, and may either compliment or be an alternative to thin plates. Grooves give more control over the sizes of pieces produced, which could be tailored to the wavelengths of the likely RADAR signals. The addition of grooves to the decoy plates also speeds the ignition times of the plates by allowing hot ignition gases to pass along the grooves The decoy plate composition may also be adapted such that at least some of the hot metal produced by the combustion of a decoy plate is molten. By selecting the composition of the decoy plates such that the hot metal produced has a melting point lower than the temperature reached by the exothermic combustion reaction then at least some of that metal produced will be molten.

Molten metal will radiate in the IR region and will quickly cool enough to solidify forming various shapes, from droplets to misshapen plates depending upon the proportion of metal which was molten initially. These shapes produced will be more effective at scattering incident RADAR radiation and will have a greater range of reflective characteristics.

Conveniently the decoy plates are interlayered with combustible cloth material. The cloth can act as a spacer to reduce the weight of the decoy and can aid in dispersal of the decoy plates by reducing the tendency of the plates to stick to one another. Also, combustible cloth will contribute to the effectiveness of the decoy and can be chosen to produce negligible visible or UV radiation.

BRIEF DESCRIPTION OF THE DRAWINGS

Further advantages and embodiments of the invention will now be described by way of example only with reference to the accompanying drawings in which.

DETAILED DESCRIPTION OF PREFERRED EMBODIMENTS

Figure 1:
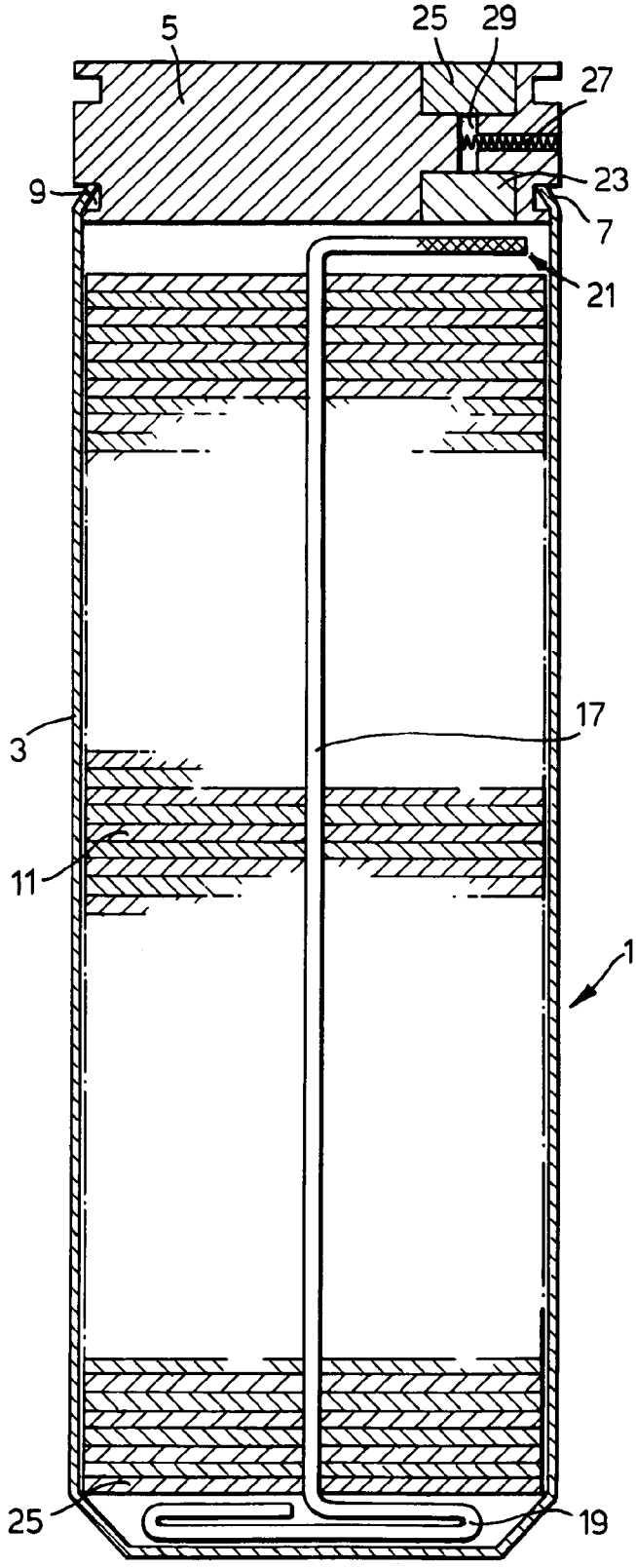
FIG. 1 shows a sectional view of a decoy flare according to the present invention.

Referring now to FIG. 1, a rupturable container, generally indicated 1, has a cylindrical casing 3 with an open end, the open end being sealed by a lid 5. The lid 5 is held in place as the edges 7 of the open end of the casing 3 are slightly crimped into a groove 9 in the lid 5. A plurality of decoy plates 11 are stacked in the casing 3.

Figure 2:
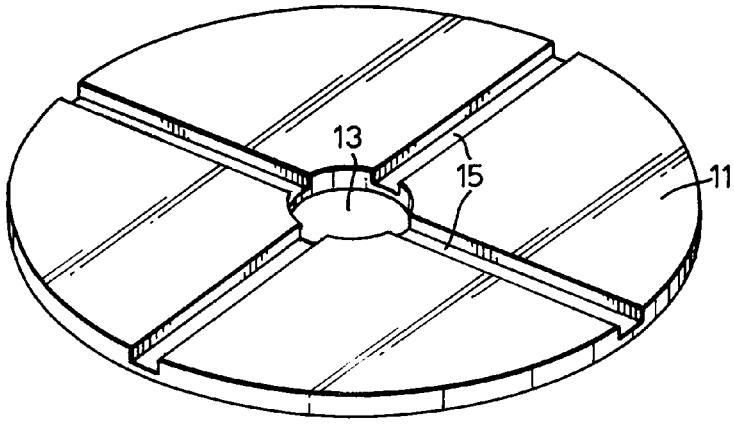
FIG. 2 shows a decoy plate suitable for use in the flare shown in FIG. 1.

One type of decoy plate suitable for use in this flare is shown in FIG. 2. The decoy plate is in the form of a disk 11 provided with a central hole 13. The disk 11 has a diameter of about 45 mm and a thickness of 0.6 mm with the central hole 13 having a diameter of 6 mm. Grooves 15 extend radially from the central hole 13 to the edge of the disk, the grooves being about 1 mm wide and 0.4 mm deep.

In one particular embodiment the disk 11 is formed from a particulate composition of 86% by weight iron (Fe) and 14% by weight potassium perchlorate ($KClO_4$) pressed together under a load of about 100 MPa. The iron particles are around 5-15 μm in size and the potassium perchlorate particles are greater than 45 μm in size. Upon ignition the iron and potassium perchlorate undergo a combustion reaction to produce oxides of iron and potassium chloride the principle reaction being;

$$3Fe+KClO_4 \rightarrow KCl+Fe_3O_4+Heat \quad (1)$$

It can be seen that as the atomic weight of iron is about 56 and that of potassium perchlorate is about 90 then the stoichiometric mixture would have about 65% by weight iron with 35% by weight of potassium perchlorate. It is apparent therefore that approximately 60% by weight of the disk is present as excess iron. However, in use the production of other iron oxides would occur and the reaction would be complemented by oxygen in the atmosphere thus the actual amount of excess iron would be lower than this. The typical temperature reached by such a disk would be around 1000° with a burn rate of about 10 cm/s.

In an alternative embodiment the disk 11 comprises a pressed particulate composition of aluminium (Al) and ferric oxide ($Fe_2O_3$). Upon ignition of this mixture the aluminium and ferric oxide undergo a combustion reaction to produce iron and aluminium oxide, the principle reaction being;

$$2Al+Fe_2O_3 \rightarrow 2Fe+Al_2O_3+Heat \quad (2)$$

Here it can be seen that the reaction produces iron thus ignition of the disk 11 results in the production of red hot iron. The disk 11 has a nearly stoichiometric ratio of aluminium to ferric oxide with 30% by weight of the disk being aluminium.

In a third embodiment the disk 11 could comprise a pressed particulate composition of titanium (Ti) and manganese dioxide ($MnO_2$) which, on ignition undergoes a combustion reaction produce manganese and oxides of titanium, one of the principle reactions being;

$$Ti+MnO_2 \rightarrow Mn+TiO_2+Heat \quad (3)$$

It will, of course, be apparent to one skilled in the art that other suitable metal fuels and oxidants could be used.

Referring back to FIG. 1 the plates 11 are stacked with an ignition cord 17 running from adjacent the lid 5 through the centre of the decoy plates 11 to form a coil 19 at the closed end of the casing 3. The ignition cord has its primed end 21 located adjacent an ignition transfer means 23 in the lid 5. A piston 25, such as a millboard, plastic or aluminium disk, for example, having a diameter equal to or just less than that of the interior of the casing, is located between the ignition cord 21 and the stack of decoy plates 11.

For certain applications the decoy plates can be stacked interlayered with a combustible cloth (not shown) in order to reduce the tendency for the ignited plates to stick to one another and to reduce the amount of plates in the stack and therefore the weight of the decoy.

In use pyrotechnic mixture 25 is ignited by, for example, a standard electrical igniter (not shown), and the rupturable container is deployed into the air. Once the rupturable container is clear of its housing, spring 27 is released allowing the ignition stimulus to travel down tube 29 to ignite delay 23. Delay 23 allows the flare to move away from its housing before igniting primed end 21 of the ignition cord 17. Should the rupturable container become jammed spring 27 prevents propagation of the ignition stimulus thus preventing the decoy flare from igniting inside its housing.

Ignition of the primed end 21 of the ignition cord 17 causes the cord to quickly combust, igniting the decoy plates 11 as the fireball passes down the cord. The gasses generated from this combustion and ignition of the decoy plates 11 causes a build up of pressure in the casing which is enough to the eject the lid 5. The first few decoy plates 11 will probably fall out of the casing. Meanwhile the combustion of the ignition cord coil 19 produces a large amount of gas which drives the piston 25 to eject the ignited decoy plates 11.

Generally the dispersion of the decoy plates 11 may be altered by choosing an ignition train which generates more or less gas. A useful ignition cord may be, for example, a magnesium/Viton/Teflon (MTV) ignition cord which generates useful quantities of gas to disperse the plates over a large area.

Figure 3:
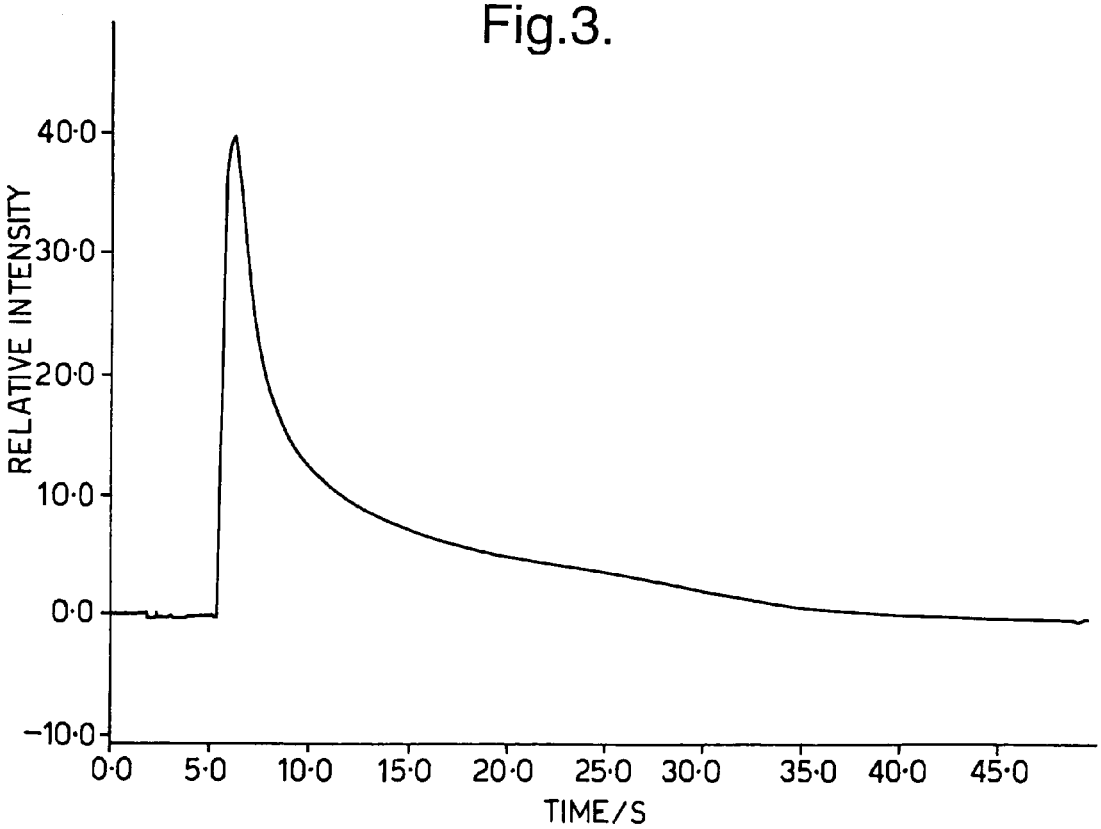
FIG. 3 shows a plot of relative intensity of infra-red radiation against time for ignition of a typical decoy plate suitable for use in a flare according to the present invention.

The typical variation in intensity of the total IR radiation emission of a decoy plate not having a grooved surface is shown in FIG. 3. The plate ignited was a 0.5 mm thick disk of 86% iron and 14% potassium perchlorate having a diameter of 47 mm.

It can be seen from the plot that even without grooves in the surface the disk shows a very fast rise time from ignition to maximum intensity, ensuring that the decoy starts operating within the field of view of the missile. The peak intensity drops relatively rapidly but the intensity stays moderately high for a long duration due to the radiating metal present after reaction. Thus the flare offers a fast response coupled with a long duration and is suitable for use with fast or slow targets. Also, whilst the initial ignition may trigger a countermeasures device and cause the missile to ignore its guidance system for a short time, when the guidance comes back on line the decoy will still be radiating and acting as a decoy but without any of the telltale characteristics of known decoys.

The invention claimed is:

1. An expendable infra-red radiating means comprising:

a rupturable container;

a plurality of decoy plates housed within the rupturable container and ejected therefrom upon rupture; and an igniter for igniting the decoy plates, and at least assisting in rupturing said container wherein the decoy plates comprise a composition of a metal and an oxidant capable of an exothermic combustion reaction upon ignition, the composition being such that the combustion reaction produces negligible radiation in the visible or ultra-violet regions and wherein, following completion of the combustion reaction, the decoy plate comprises hot metal emitting infra-red radiation.

2. An expendable infra-red radiating means as claimed in claim 1 wherein the composition of the decoy plates is selected such that the mass of hot metal emitting infra-red radiation after combustion of the decoy plate is at least 10% of the mass of the decoy plate before combustion.

3. An expendable infra-red radiating means as claimed in claim 1 wherein the composition of the decoy plates comprises a stoichiometric excess of metal.

4. An expendable infra-red radiating means as claimed in claim 1 wherein the composition of the decoy plates is selected such that a reaction product of the exothermic combustion reaction between the metal and the oxidant is hot metal emitting infra-red radiation.

5. An expendable infra-red radiating means as claimed in claim 4 wherein the metal is a first metal and the oxidant is an oxide of a second metal.

6. An expendable infra-red radiating means as claimed in claim 1 wherein the metal is selected from the group consisting of aluminium, iron, calcium, titanium, silicon and boron.

7. An expendable infra-red radiating means as claimed in claim 1 wherein the metal is iron and the oxidant is potassium perchlorate.

8. An expendable infra-red radiating means as claimed in claim 7 wherein 82 to 88% by weight of the decoy plate is iron and 18 to 12% by weight of the decoy is potassium perchlorate.

9. An expendable infra-red radiating means as claimed in claim 1 wherein the metal is aluminium and the oxidant is selected from the group consisting of ferric oxide, calcium oxide, tungsten dioxide, tungsten trioxide, manganese dioxide and sodium chlorate.

10. An expendable infra-red radiating means as claimed in claim 9 wherein the oxidant is ferric oxide.

11. An expendable infra-red radiating means as claimed in claim 1 wherein the metal is titanium and the oxidant is manganese dioxide.

12. An expendable infra-red radiating means as claimed in claim 1 wherein the decoy plates comprise a pressed composition of a particulate metal and particulate oxidant.

13. An expendable infra-red radiating means as claimed in claim 1 wherein the decoy plate composition further comprises a binder material.

14. An expendable infra-red radiating means as claimed in claim 1 wherein the thicknesses of the decoy plates are adapted such that, in use, at least some of the decoy plates break up on dispersal from the rupturable container.

15. An expendable infra-red radiating means as claimed in claim 1 wherein the decoy plates have grooves running across the surface.

16. An expendable infra-red radiating means as claimed in claim 1 wherein the decoy plate composition is adapted such that at least some of the hot metal remaining after the combustion of a decoy plate is molten.

17. An expendable infra-red radiating means as claimed in claim 1 wherein the plurality of decoy plates are interlayered with combustible cloth material.

18. An expendable infra-red radiating means comprising:

a rupturable container;

a plurality of decoy plates housed within the rupturable container and ejected therefrom upon rupture; and means for igniting the decoy plates, and at least assisting in rupturing said container wherein the decoy plates comprise a composition of a metal and an oxidant capable of an exothermic combustion reaction upon ignition, the composition being such that the combustion reaction produces negligible radiation in the visible or ultra-violet regions and wherein, following completion of the combustion reaction, the decoy plate comprises hot metal emitting infra-red radiation.

19. An expendable infra-red radiating means comprising:

a rupturable container;

a plurality of decoy plates housed within the rupturable container and ejected therefrom upon rupture; and an igniter, said igniter igniting the decoy plates and at least assisting in rupturing said container wherein the decoy plates comprise a composition of a metal and an oxidant capable of an exothermic combustion reaction upon ignition, the composition being such that the combustion reaction produces negligible radiation in the visible or ultra-violet regions and wherein, following completion of the combustion reaction, the decoy plate comprises hot metal emitting infra-red radiation.

* * * * *